US006698161B1

(12) United States Patent
Rossi

(10) Patent No.: US 6,698,161 B1
(45) Date of Patent: Mar. 2, 2004

(54) DEVICE FOR LOADING FILM ON MACHINES FOR WRAPPING PRODUCTS

(75) Inventor: Bruno Rossi, Rimini (IT)

(73) Assignee: Robopac S.A., Falciano (SM)

( * ) Notice: Subject to any disclaimer, the term of this patent is extended or adjusted under 35 U.S.C. 154(b) by 0 days.

(21) Appl. No.: 09/937,557

(22) PCT Filed: Mar. 16, 2000

(86) PCT No.: PCT/IB00/00284

§ 371 (c)(1),
(2), (4) Date: Sep. 25, 2001

(87) PCT Pub. No.: WO00/58155

PCT Pub. Date: Oct. 5, 2000

(30) Foreign Application Priority Data

Mar. 26, 1999 (IT) ..... B099A0143

(51) Int. Cl.[7] ..... B65B 41/16

(52) U.S. Cl. ..... 53/389.1; 53/382.2; 53/389.4

(58) Field of Search ..... 53/389.2, 389.4, 53/556, 389.1

(56) References Cited

U.S. PATENT DOCUMENTS

| | | | | | |
|---|---|---|---|---|---|
| 4,409,777 | A | | 10/1983 | White et al. | |
| 4,747,254 | A | * | 5/1988 | Lancaster | 53/556 |
| 5,715,655 | A | * | 2/1998 | Soderberg | 53/441 |
| 5,875,616 | A | * | 3/1999 | Paavola et al. | 53/556 |

FOREIGN PATENT DOCUMENTS

| | | |
|---|---|---|
| EP | 0 220 712 A1 | 5/1987 |
| EP | 0 293 352 A2 | 11/1988 |

* cited by examiner

*Primary Examiner*—Rinaldi I. Rada
*Assistant Examiner*—Gloria R Weeks
(74) *Attorney, Agent, or Firm*—Fay, Sharpe, Fagan, Minnich & McKee, LLP

(57) ABSTRACT

In a device for loading film (3) on machines for wrapping products, a carriage (4) which supports and moves a reel (5) has a guard (9) covering the end of a pair of rollers (6, 7) for pre-stretching and feeding the film (3), opposite the end attached to a platform (8) which supports the rollers; the guard (9) covers each roller (6, 7) in such a way that it defines a continuous through-channel (C) at least at the surfaces **(6*s*, 7*s*) of the rollers (6, 7) which make contact with the film (3), so that the film (3)** can be inserted between said surfaces from the outside.

9 Claims, 3 Drawing Sheets

DEVICE FOR LOADING FILM ON MACHINES FOR WRAPPING PRODUCTS

This application is a 371 of PCT/IB00/00284 dated Mar. 16, 2000.

TECHNICAL FIELD

The present invention relates to a device for loading film on machines for wrapping products.

BACKGROUND ART

Current machines for wrapping groups of products (of the automatic or semi-automatic type) basically consist of a platform which supports the groups of products on a pallet (the platform may be rotary or fixed) and a structure which supports the film feed means. This structure may consist of a simple vertical column, on which a unit equipped with the above-mentioned film feed means (with rotary platform) slides in both directions, or may have horizontal arms or prongs which rotate about the group of products (usually with fixed platform).

The film feed means in turn consist of a film reel, rotatably mounted on a vertical shaft, which is attached to a plate which forms part of a feed means support carriage. In addition to the reel, there is a plurality of rollers, again with vertical axes attached to the plate, designed to allow the tensioned film to be guided and fed towards the group of products.

As well as these elements, in the current wrapping machines the use of motor-driven pre-stretching units for the wrapping film is increasingly common, especially when cold-stretch films are used. This pre-stretching procedure allows an increase in the film stabilising effect with a proportional reduction in the weight of the film on each group of products wrapped.

In order to obtain correct stretching of the film fed, that is to say, without the film sliding around the rollers and, above all, without a significant contraction or lateral reduction in the film web (which cancels out the reduction in film weight), the use of at least one pair of motor-driven rollers, independent of one another, is necessary in order to allow different peripheral speeds, with the two rollers positioned very close to one another and a large angle for film winding around the two rollers.

These operating conditions, together with the existing structure of the feed means, mean that the film feed unit has a large number of rollers which are very close to one another on the drive carriage. This architecture, therefore, makes it difficult for the operator to load or insert the film (when the reel ends or if the film breaks), since the spaces between rollers are very limited and there is also sometimes a danger that the operator's fingers may be crushed when manually inserting the end of the film.

In an attempt to overcome these disadvantages, the manufacturers of these machines designed a first solution consisting of a carriage which supports the reel and the guide and pre-stretching rollers in a cantilever configuration, that is to say using only a support rod. This architecture partly solves the problem of loading the film in the rollers (one end of the rollers is free), but requires precision sizing of the single support part and extremely stiff rollers (since there is only one resting point) which considerably raises the cost of the machine, as well as complicating assembly. In addition, the transmission and roller speed adjustment parts (variable speed motors and pulley/gear units) are concentrated at one end of the rollers, making the longitudinal dimension of the roller carriage very large and the configuration of the mechanisms which transmit motion to the rollers complex.

In a second solution, the support carriage was split into a fixed part and a mobile part, that is to say, a part which turns about a horizontal or vertical pivot axis. This solution allows the operator to load the film, after turning the mobile part, by threading the end of the film into the free area of the fixed part.

However, the second solution also has disadvantages, due to the increased size and weight of the carriage, necessary in order to split it, with the consequent use of lifting parts suitable for this purpose, thus raising the cost of unit production. In this solution, the pre-stretching rollers must also be moved away from one another, and it is possible to reduce the winding angles, with the consequent risks that the quality of the pre-stretching operation may be lowered.

DISCLOSURE OF THE INVENTION

The aim of the present invention is, therefore, to overcome the above-mentioned disadvantages by providing a device for loading film which has an extremely compact structure, but which can be used at high speed and allows the operator to rapidly insert the end of the film between the pre-stretching rollers, whilst maintaining production levels similar to that of conventional machines.

The technical features of the present invention, in accordance with the above-mentioned aims, are set out in the claims herein and the advantages more clearly illustrated in the detailed description which follows, with reference to the accompanying drawings, which illustrate a preferred embodiment without limiting the scope of application, and in which:

Figure 1:
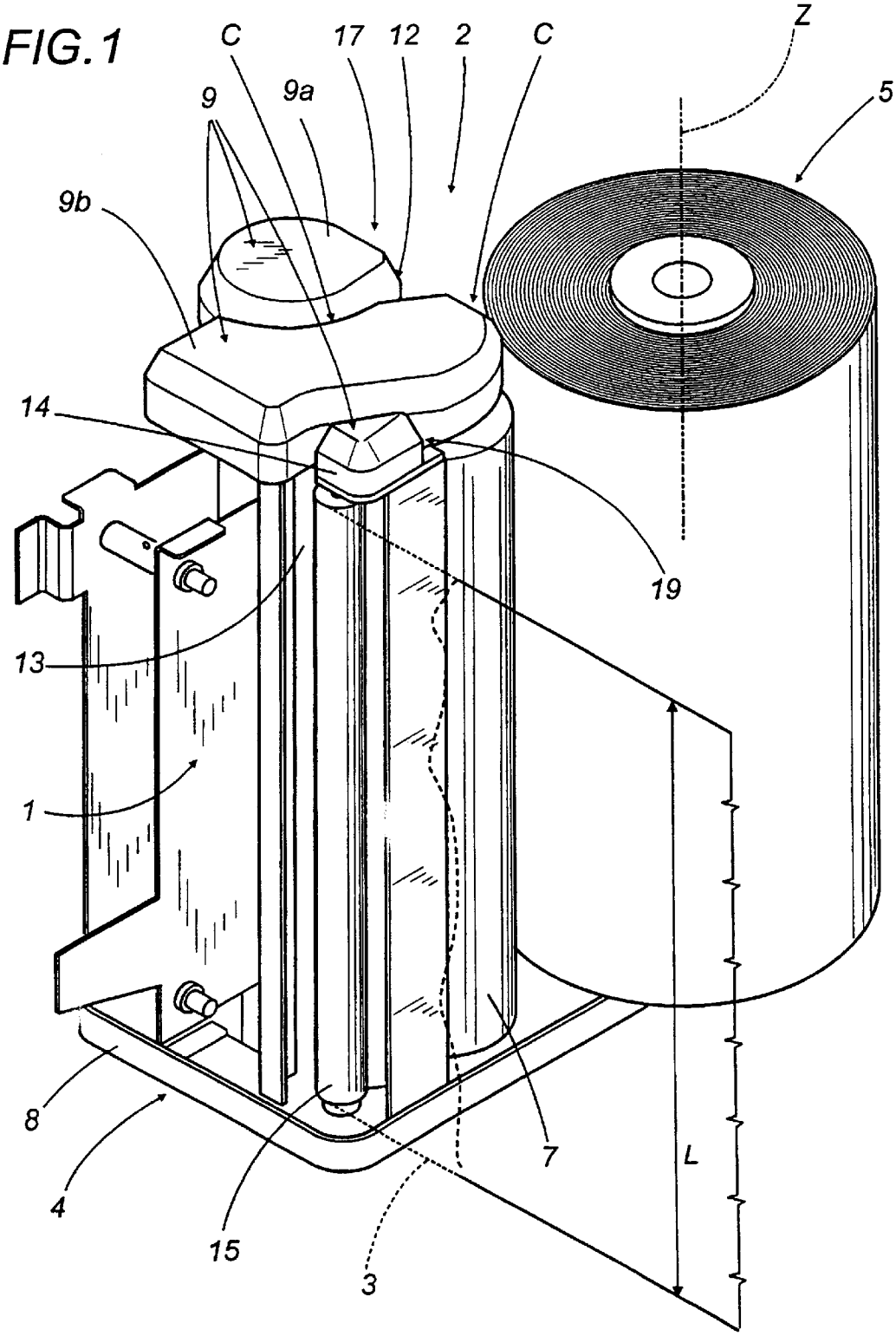
FIG. 1 is a perspective view with some parts cut away to better illustrate others, of the device for loading film made in accordance with the present invention.

With reference to the accompanying drawings and in particular FIG. 1, the device disclosed is used to load film, in particular but without limiting the scope of its application, cold-stretch films, on machines for wrapping groups of products (of the known type and not illustrated).

The parts of these machines which form the subject matter of the present invention comprise a support frame 1 for the feed and preparation unit 2 for the film 3 (that is to say, a film 3 cold pre-stretching unit) to be wrapped around the group of products.

The unit 2 comprises a carriage 4 which supports a reel 5 of film 3 with vertical axis Z in such a way that it can rotate, and at least one pair of rollers 6 and 7 which rotate about their axes Z1 and Z2, parallel with the axis Z of the reel 5.

The two rollers 6 and 7 are designed to pre-stretch the film 3 and one end of the rollers is attached to the carriage 4 by means of a platform 8. The two rollers 6 and 7 (see also FIGS. 2 and 3) are positioned relative to one another in such a way that they allow the passage of the film 3, with width L, along a feed path defined by part of the corresponding outer circumference or contact surface 6*s* and 7*s*.

The carriage 4 is also equipped with a guard 9 which covers the end of the pair of rollers 6 and 7 opposite the end attached to the platform 8. This guard 9 covers each roller 6 and 7 in such a way that it defines a continuous through-channel C passing at least between the contact surfaces 6*s* and 7*s* of the rollers 6 and 7 for insertion of the film 3 between the contact surfaces, from the outside.

In order to form the above-mentioned channel C, there are two holes 10 and 11 passing through the guard 9 from the outside, at least at the opposite portions of the surfaces of the rollers 6 and 7 defining the above-mentioned surfaces 6*s* and 7*s* for contact with the film 3 to be pre-stretched.

More specifically with reference to the construction details, the guard 9 consists of at least two separate parts 9*a* and 9*b*, each supporting and covering a relative roller 6 and 7, defining another support platform for the rollers. In particular, the guard 9 defines an upper support platform for the carriage 4, securing the rollers 6 and 7 on both sides.

In order to stiffen the guard 9 (so as to better secure the ends of the rollers 6 and 7), each part 9*a* and 9*b* of the guard is individually attached to the other platform 8 by its vertical portions 12 and 13 which cover part of each roller 6 and 7.

Obviously, these parts 12 and 13 extend at the side of areas of the rollers 6 and 7 through which the film 3 does not pass.

Figure 2:
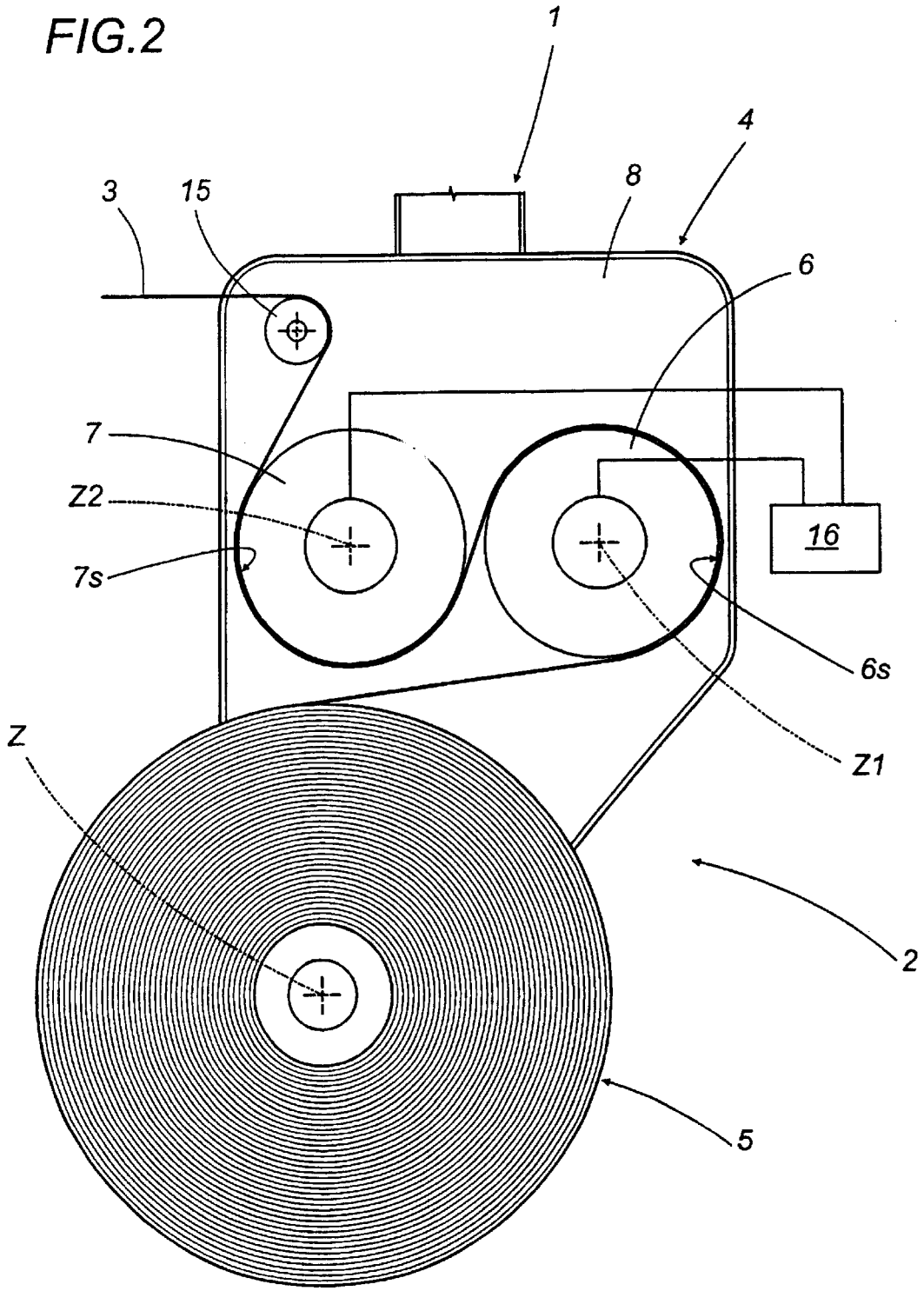
FIG. 2 is a top plan view of the device illustrated in FIG. 1.
Figure 3:
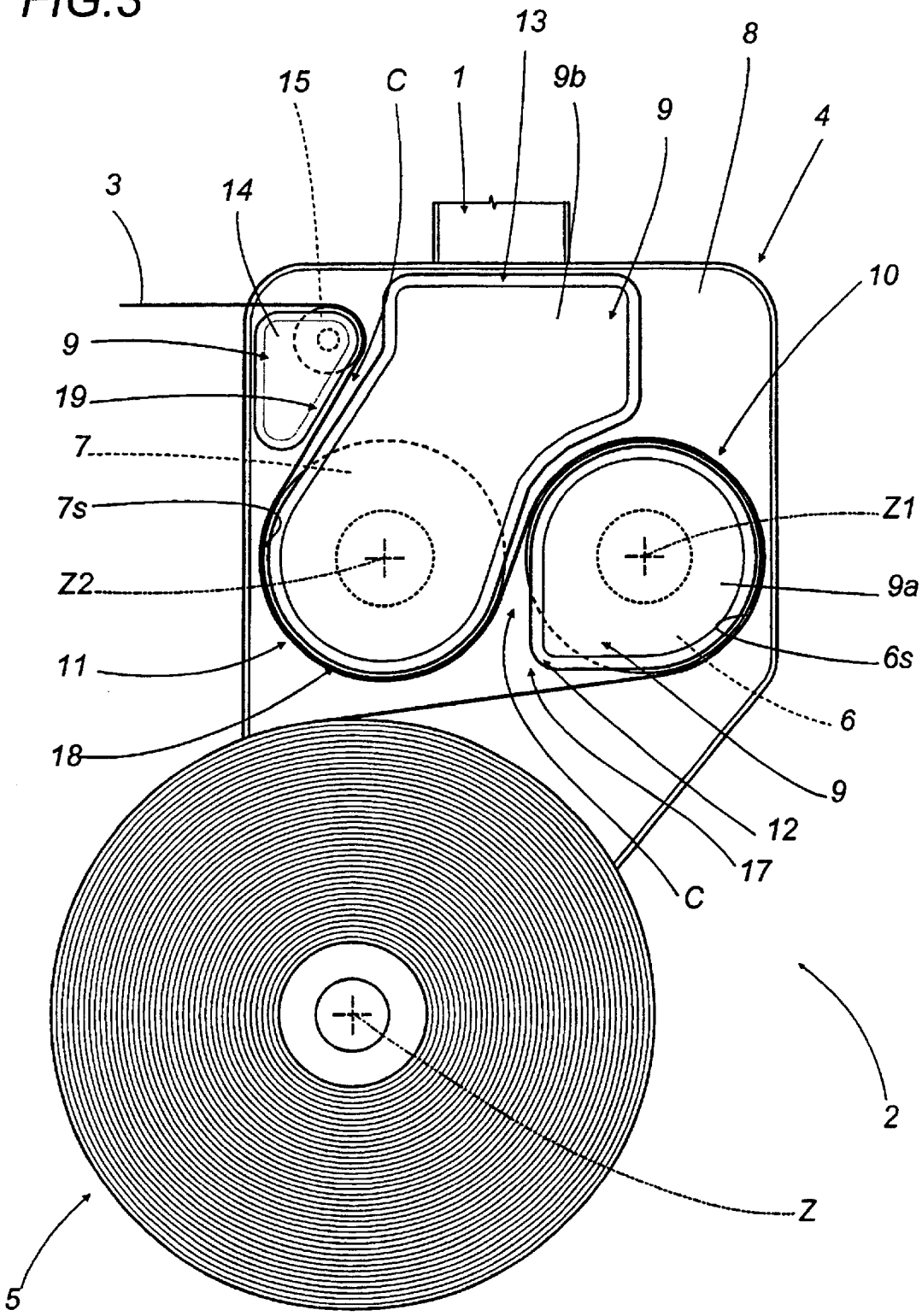
FIG. 3 is a top plan view with some parts cut away to better illustrate others, of the device illustrated in the previous figures.

As illustrated in FIGS. 1, 2 and 3, a third part 14 of the guard 9 is envisaged, its structure similar to the other parts, which supports and covers the upper end of the third feed roller 15 for the film 3, which feeds the latter towards the group of products to be wrapped, located close to the pair of rollers 6 and 7.

Another particularly advantageous element of the device derives from the fact that each part 9*a*, 9*b* and 14 of the guard 9 has edges 17, 18 and 19 which are rounded in the direction of the relative roller 6, 7 and 15 and supported in such a way as to define a guide zone for the film 3 to be inserted between said rollers. This feature allows rapid insertion of the film 3, preferably gathered in a bundle (not illustrated), from the top of the carriage and without any risk to the operator.

Another feature of the present device relates to the pair of rollers 6 and 7, which consists of motor-driven rollers (with mechanisms of the known type, therefore not illustrated in detail).

The rotation of the motor-driven rollers is controlled by a microprocessor unit 16 (which is part of the machine control unit, of the known type, therefore not illustrated).

In operation, this solution leaves one end of each roller free of connecting mechanisms (as in conventional models). Said end can be used to connect the roller directly to the guard in a simple, compact fashion, instead of to the transmission.

The motor-driven rollers have frequency changers which, controlled by the above-mentioned microprocessor, allow the speed of the rollers to be adjusted with continuous variations in the film 3 pre-stretching value, without using mechanical elements or having to substitute pinions/gears.

A device structured in this way, therefore, fulfills the preset aims thanks to an extremely simple, compact structure and the use of motor-driven rollers which allow a reduction in the number of mechanical drive/speed change parts at the ends of the rollers. This particular feature of the motor-driven rollers allows the guard at the top of the rollers to be shaped so that it has a channel C for insertion of the film from the outside rapidly, safely and with easy manual operations. All of this is achieved while maintaining a stiffness of the structure suitable for the work performed by the carriage and for film pre-stretching requirements.

The carriage, therefore, has a reduced number of feed rollers, large angles for winding around the pre-stretching rollers (see FIGS. 2 and 3) and a much reduced distance between the latter, to prevent reduction of the lateral strip of the film during stretching.

The present invention may be subject to numerous modifications and variations, all encompassed by the design concept. Moreover, all components may be substituted with technically equivalent parts.

What is claimed is:

1. A device for loading film on machines for wrapping groups of products, the machines comprising a support frame for a feed and preparation unit for the film to be wrapped around the group of products; said unit comprising at least one carriage, rotatably supporting a reel of the film with a vertical axis, and at least one pair of rollers which rotate about their axes, parallel with the axis of the reel, one end of the rollers being attached to the carriage by means of a platform, said pair of rollers being designed to allow the passage of the film along a feed path defined by part of the corresponding outer circumference or contact surface of each roller that contacts said film, said device also comprising a guard which covers the end of the pair of rollers opposite that attached to the platform, said guard covering each roller in such a way that at least at the contact surfaces of the rollers it forms a continuous through-channel for insertion of the film into the feed path from the outside, wherein said guard consists of at least separate parts, each covering a respective roller, wherein each part of the guard is separately attached to the platform by vertical portions which at least partially cover the respective roller covered thereby.

2. The device according to claim 1, wherein the guard has holes passing through it from the outside at least at the portions of the surfaces opposite the pair of rollers defining the surfaces which make contact with the film.

3. The device according to claim 1, wherein the pair of rollers consists of motor-driven rollers whose rotation is controlled by a microprocessor unit.

4. The device according to claim 1, wherein the guard constitutes the upper support platform for the carriage.

5. A device for loading film on machines for wrapping groups of products, the machines comprising a support frame for a feed and preparation unit for the film to be wrapped around the group of products; said unit comprising at least one carriage, rotatably supporting a reel of the film with a vertical axis, and at least one pair of rollers which rotate about their axes, parallel with the axis of the reel, one end of the rollers being attached to the carriage by means of a platform, said pair of rollers being designed to allow the passage of the film along a feed path defined by part of the corresponding outer circumference or contact surface of each roller that contacts said film, said device also comprising a guard which covers the end of the pair of rollers opposite that attached to the platform, said guard covering each roller in such a way that at least at the contact surfaces of the rollers it forms a continuous through-channel for insertion of the film into the feed path from the outside, wherein said guard consists of at least separate parts, each covering a respective roller, said device further comprising a third part of the guard, adapted to support and cover a third film feed roller close to the pair of rollers.

6. The device according to claim 5, wherein the guard constitutes an upper support platform for the carriage.

7. A device for loading film on machines for wrapping groups of products, the machines comprising a support frame for a feed and preparation unit for the film to be wrapped around the group of products; said unit comprising at least one carriage, rotatably supporting a reel of the film with a vertical axis, and at least one pair of rollers which rotate about their axes, parallel with the axis of the reel, one end of the rollers being attached to the carriage by means of a platform, said pair of rollers being designed to allow the passage of the film along a feed path defined by part of the corresponding outer circumference or contact surface of each roller that contacts said film, said device also comprising a guard which covers the end of the pair of rollers opposite that attached to the platform, said guard covering each roller in such a way that at least at the contact surfaces of the rollers it forms a continuous through-channel for insertion of the film into the feed path from the outside, wherein said guard consists of at least separate parts, each covering a respective roller, wherein each part of the guard has an outer edge which is rounded towards the roller, being supported in such a way as to form a guide zone for the film to be inserted between the rollers.

8. An apparatus comprising:

a machine comprising a support frame for a feed and preparation unit for film to be wrapped around a group of products, said feed and preparation unit comprising:

(i) at least one carriage rotatably supporting a reel of film that rotates about a reel axis; and, (ii) first and second rollers that rotate about respective axes that are each parallel with the reel axis, a first end of each of the first and second rollers being attached to the carriage by means of a platform and a second end of each of the first and second rollers being spaced from the platform, said first and second rollers allowing passage of said film therebetween along a feed path;

a guard that covers the respective second ends of the first and second rollers, said guard defining a through-channel aligned with said feed path for insertion of film through said guard between said first and second rollers into said feed path in a direction transverse to said feed path, said guard comprising at least a first part that covers said second end of said first roller and a second part that covers said second end of said second roller.

9. The apparatus as set forth in claim 8, wherein said first part of said guard rotatably supports said second end of said first roller and said second part of said guard rotatably supports said second end of said second roller.

* * * * *